US010329956B2

(12) United States Patent
Scott

(10) Patent No.: US 10,329,956 B2
(45) Date of Patent: Jun. 25, 2019

(54) MULTI-FUNCTION BOSS FOR A TURBINE EXHAUST CASE

(71) Applicant: United Technologies Corporation, Hartford, CT (US)

(72) Inventor: Jonathan Ariel Scott, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 708 days.

(21) Appl. No.: 14/758,382

(22) PCT Filed: Dec. 19, 2013

(86) PCT No.: PCT/US2013/076495

§ 371 (c)(1),
(2) Date: Jun. 29, 2015

(87) PCT Pub. No.: WO2014/105619

PCT Pub. Date: Jul. 3, 2014

(65) Prior Publication Data

US 2016/0201490 A1 Jul. 14, 2016

Related U.S. Application Data

(60) Provisional application No. 61/747,260, filed on Dec. 29, 2012.

(51) Int. Cl.

| | |
|---|---|
| ***F01D 25/24*** | (2006.01) |
| ***F01D 25/30*** | (2006.01) |
| ***F01D 9/06*** | (2006.01) |

(52) U.S. Cl.

CPC ..... *F01D 25/24* (2013.01); *F01D 9/065* (2013.01); *F01D 25/30* (2013.01); *F05D 2220/32* (2013.01); *F05D 2230/60* (2013.01)

(58) Field of Classification Search

CPC ..... F01D 25/24; F01D 25/245; F01D 25/246; F01D 25/281; F01D 25/285; F01D 25/30;

(Continued)

(56) References Cited

U.S. PATENT DOCUMENTS 2,214,108 A 7/1938 Grece
2,875,579 A * 3/1959 Gerdan ..... F02C 7/20 60/726

(Continued)

FOREIGN PATENT DOCUMENTS

WO WO 03/020469 A1 3/2003
WO WO 2006/007686 A1 1/2006

(Continued)

OTHER PUBLICATIONS

International Search Report and Written Opinion from PCT Application Serial No. PCT/US2013/076495, dated Apr. 8, 2014, 13 pages.

*Primary Examiner* — Jason D Shanske
*Assistant Examiner* — Joshua R Beebe
(74) *Attorney, Agent, or Firm* — Kinney & Lange, P.A.

(57) ABSTRACT

A turbine exhaust case frame (100) comprises an inner ring (104), an outer ring (102), and a plurality of load-bearing struts (106). The inner ring is configured to carry load from inner bearings. The outer ring features a multi-function boss (116) with a service line aperture (124) and a mounting point for the turbine exhaust case. The load-bearing struts connect the inner ring to the outer ring, and have a service line passage (128) extending from the service line aperture to the inner ring.

16 Claims, 4 Drawing Sheets

(58) Field of Classification Search
CPC .. F01D 9/065; F05D 2240/14; F05D 2220/32; F05D 2230/60
See application file for complete search history.

(56) References Cited

U.S. PATENT DOCUMENTS 3,576,328 A 4/1971 Vase
3,802,046 A 4/1974 Wachtell et al.
3,970,319 A 7/1976 Carroll et al.
4,009,569 A 3/1977 Kozlin
4,044,555 A 4/1977 McLoughlin et al.
4,088,422 A 5/1978 Martin
4,114,248 A 9/1978 Smith et al.
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A 5/1990 Nash et al.
4,987,736 A 1/1991 Ciokajlo et al.
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 VonBenken et al.
5,100,158 A 3/1992 Gardner
5,108,116 A 4/1992 Johnson et al.
5,169,159 A 12/1992 Pope et al.
5,174,584 A 12/1992 Lahrman
5,188,507 A 2/1993 Sweeney
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,272,869 A 12/1993 Dawson et al.
5,273,397 A 12/1993 Czachor et al.
5,292,227 A * 3/1994 Czachor ..... F01D 25/162 415/142
5,312,227 A 5/1994 Grateau et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,435,124 A * 7/1995 Sadil ..... F01D 25/285 248/220.21
5,438,756 A 8/1995 Halchak et al.
5,474,305 A 12/1995 Flower
5,483,792 A * 1/1996 Czachor ..... F01D 25/162 60/796
5,558,341 A 9/1996 McNickle et al.
5,597,286 A 1/1997 Dawson et al.
5,605,438 A * 2/1997 Burdgick ..... F01D 25/145 415/182.1
5,609,467 A * 3/1997 Lenhart ..... F01D 9/065 415/142
5,632,493 A 5/1997 Gardner
5,634,767 A 6/1997 Dawson
5,691,279 A 11/1997 Tauber et al.
5,755,445 A 5/1998 Arora
5,851,105 A 12/1998 Fric et al.
5,911,400 A 6/1999 Niethammer et al.
6,163,959 A 12/2000 Arraitz et al.
6,196,550 B1 3/2001 Arora et al.
6,227,800 B1 5/2001 Spring et al.
6,337,751 B1 1/2002 Kimizuka
6,343,912 B1 2/2002 Mangeiga et al.
6,358,001 B1 3/2002 Bosel et al.
6,364,316 B1 4/2002 Arora
6,439,616 B1 8/2002 Karafillis et al.
6,439,841 B1 8/2002 Bosel
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,367,567 B2 5/2008 Farah et al.
7,371,044 B2 5/2008 Nereim
7,377,098 B2 * 5/2008 Walker ..... F01D 9/065 184/6.11
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 12/2011 Herbst et al.
8,091,371 B2 1/2012 Durocher et al.
8,092,161 B2 1/2012 Cai et al.
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,215,901 B2 7/2012 Kapustka
8,221,071 B2 7/2012 Wojno et al.
8,245,399 B2 8/2012 Anantharaman et al.
8,245,518 B2 8/2012 Durocher et al.
8,282,342 B2 10/2012 Tonks et al.
8,371,127 B2 2/2013 Durocher et al.
8,371,812 B2 2/2013 Manteiga et al.
2003/0025274 A1 2/2003 Allan et al.
2003/0042682 A1 3/2003 Inoue
2003/0062684 A1 4/2003 Inoue
2003/0062685 A1 4/2003 Inoue
2005/0046113 A1 3/2005 Inoue
2006/0010852 A1 1/2006 Gekht et al.
2007/0280819 A1 * 12/2007 Eleftheriou ..... F01D 25/162 415/115
2008/0216300 A1 9/2008 Anderson et al.
2008/0253884 A1 * 10/2008 Snyder ..... F01D 25/26 415/208.1
2010/0132370 A1 * 6/2010 Durocher ..... F01D 25/162 60/796
2010/0132371 A1 6/2010 Durocher et al.
2010/0132374 A1 6/2010 Manteiga et al.
2010/0132376 A1 6/2010 Durocher et al.
2010/0132377 A1 6/2010 Durocher et al.
2010/0202872 A1 8/2010 Weidmann
2010/0236244 A1 9/2010 Longardner
2010/0275572 A1 11/2010 Durocher et al.
2010/0275614 A1 11/2010 Fontaine et al.

(56) References Cited

U.S. PATENT DOCUMENTS

| | | | | |
|---|---|---|---|---|
| 2010/0307165 | A1 | 12/2010 | Wong et al. | |
| 2011/0000223 | A1 | 1/2011 | Russberg | |
| 2011/0005234 | A1 | 1/2011 | Hashimoto et al. | |
| 2011/0061767 | A1 | 3/2011 | Vontell et al. | |
| 2011/0073745 | A1* | 3/2011 | Duchatelle | F01D 9/04 248/637 |
| 2011/0081239 | A1 | 4/2011 | Durocher | |
| 2011/0081240 | A1 | 4/2011 | Durocher et al. | |
| 2011/0085895 | A1 | 4/2011 | Durocher et al. | |
| 2011/0214433 | A1 | 9/2011 | Feindel et al. | |
| 2011/0252808 | A1* | 10/2011 | McKenney | F01D 25/164 60/796 |
| 2011/0262277 | A1 | 10/2011 | Sjoqvist et al. | |
| 2011/0302929 | A1 | 12/2011 | Bruhwiler | |
| 2012/0111023 | A1 | 5/2012 | Sjoqvist et al. | |
| 2012/0156020 | A1 | 6/2012 | Kottilingam et al. | |
| 2012/0186254 | A1 | 7/2012 | Ito et al. | |
| 2012/0204569 | A1 | 8/2012 | Schubert | |
| 2013/0011242 | A1 | 1/2013 | Beeck et al. | |
| 2013/0224012 | A1* | 8/2013 | Durocher | F01D 25/28 415/213.1 |

FOREIGN PATENT DOCUMENTS

| | | | |
|---|---|---|---|
| WO | WO 2009/157817 | A1 | 12/2009 |
| WO | WO 2010/002295 | A1 | 1/2010 |
| WO | WO 2012/158070 | A1 | 11/2012 |

* cited by examiner

MULTI-FUNCTION BOSS FOR A TURBINE EXHAUST CASE

BACKGROUND

The present disclosure relates generally to gas turbine engines, and more particularly to bosses and service line apertures in a turbine exhaust case of an industrial gas turbine engine.

A turbine exhaust case is a structural frame that supports engine bearing loads while providing a gas path at or near the aft end of a gas turbine engine. Some aeroengines utilize a turbine exhaust case to help mount the gas turbine engine to an aircraft airframe. In industrial applications, a turbine exhaust case is more commonly used to couple gas turbine engines to a power turbine that powers an electrical generator. Industrial turbine exhaust cases can, for instance, be situated between a low pressure engine turbine and a generator power turbine. A turbine exhaust case must bear shaft loads from interior bearings, and must be capable of sustained operation at high temperatures.

Turbine exhaust cases serve two primary purposes: airflow channeling and structural support. Turbine exhaust cases typically comprise structures with inner and outer rings connected by radial struts. The struts and rings often define a core flow path from fore to aft, while simultaneously mechanically supporting shaft bearings situated axially inward of the inner ring. The components of a turbine exhaust case are exposed to very high temperatures along the core flow path. Various approaches and architectures have been employed to handle these high temperatures. Some turbine exhaust case frames utilize high-temperature, high-stress capable materials to both define the core flow path and bear mechanical loads. Other frame architectures separate these two functions, pairing a structural frame for mechanical loads with a high-temperature capable fairing to define the core flow path. In industrial applications, turbine exhaust cases are sometimes anchored to installation structures to support the gas turbine engine, and can carry service lines for cooling or lubrication.

SUMMARY

The present disclosure is directed toward a turbine exhaust case frame comprising an inner ring, an outer ring, and a plurality of load-bearing struts. The inner ring is configured to carry load from inner bearings. The outer ring features a multi-function boss with a service line aperture and a mounting point for the turbine exhaust case. The load-bearing struts connect the inner ring to the outer ring, and have a service line passage extending from the service line aperture to the inner ring.

DETAILED DESCRIPTION

Figure 1:
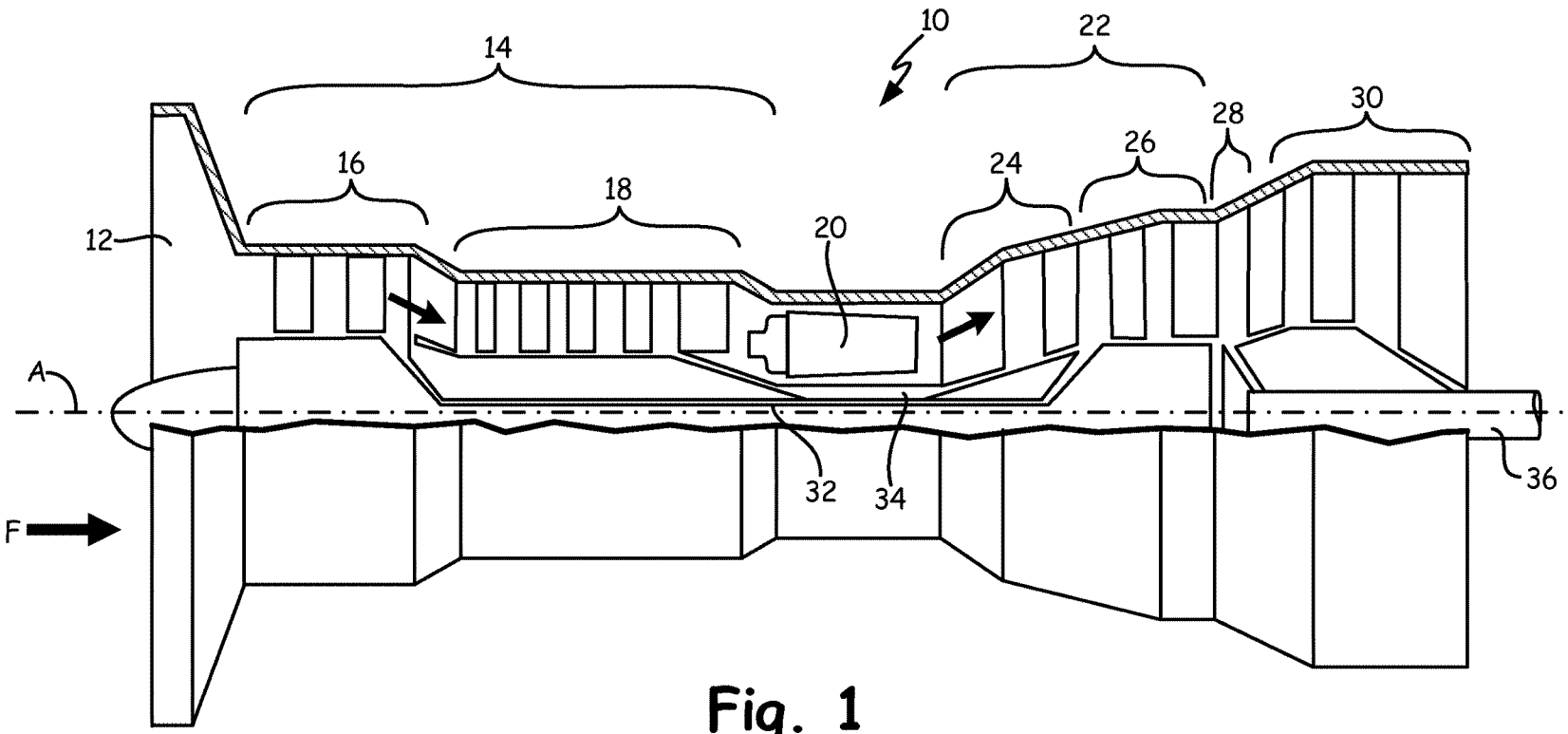
FIG. 1 is a simplified partial cross-sectional view of an embodiment of a gas turbine engine.

FIG. 1 is a simplified partial cross-sectional view of gas turbine engine 10, comprising inlet 12, compressor 14 (with low pressure compressor 16 and high pressure compressor 18), combustor 20, engine turbine 22 (with high pressure turbine 24 and low pressure turbine 26), turbine exhaust case 28, power turbine 30, low pressure shaft 32, high pressure shaft 34, and power shaft 36. Gas turbine engine 10 can, for instance, be an industrial power turbine.

Low pressure shaft 32, high pressure shaft 34, and power shaft 36 are situated along rotational axis A. In the depicted embodiment, low pressure shaft 32 and high pressure shaft 34 are arranged concentrically, while power shaft 36 is disposed axially aft of low pressure shaft 32 and high pressure shaft 34. Low pressure shaft 32 defines a low pressure spool including low pressure compressor 16 and low pressure turbine 26. High pressure shaft 34 analogously defines a high pressure spool including high pressure compressor 18 and high pressure compressor 24. As is well known in the art of gas turbines, airflow F is received at inlet 12, then pressurized by low pressure compressor 16 and high pressure compressor 18. Fuel is injected at combustor 20, where the resulting fuel-air mixture is ignited. Expanding combustion gasses rotate high pressure turbine 24 and low pressure turbine 26, thereby driving high and low pressure compressors 18 and 16 through high pressure shaft 34 and low pressure shaft 32, respectively. Although compressor 14 and engine turbine 22 are depicted as two-spool components with high and low sections on separate shafts, single spool or 3+ spool embodiments of compressor 14 and engine turbine 22 are also possible. Turbine exhaust case 28 carries airflow from low pressure turbine 26 to power turbine 30, where this airflow drives power shaft 36. Power shaft 36 can, for instance, drive an electrical generator, pump, mechanical gearbox, or other accessory (not shown).

In addition to defining an airflow path from low pressure turbine 26 to power turbine 30, turbine exhaust case 28 can support one or more shaft loads. Turbine exhaust case 28 can, for instance, support low pressure shaft 32 via bearing compartments (not shown) disposed to communicate load from low pressure shaft 32 to a structural frame of turbine exhaust case 28.

Figure 2:
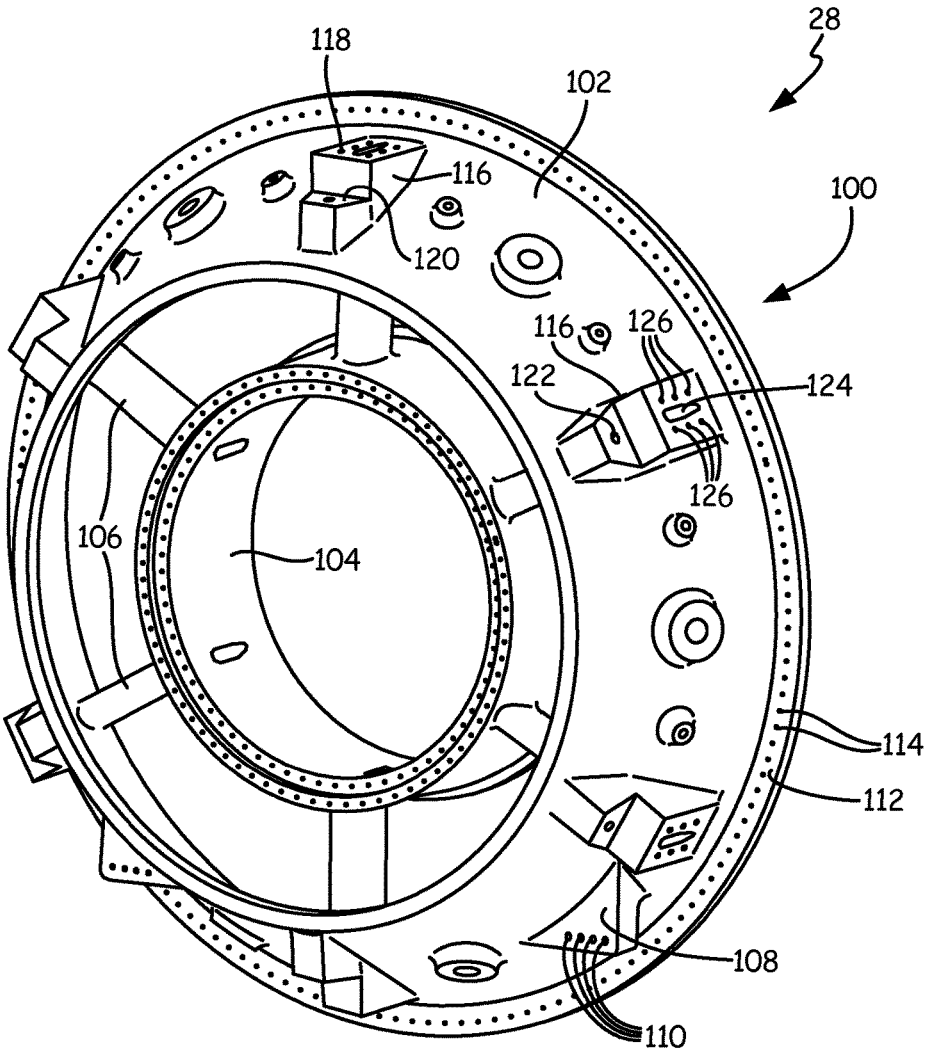
FIG. 2 is a perspective view of a turbine exhaust case of the gas turbine engine of FIG. 1

FIG. 2 provides a perspective view of one embodiment of frame 100 of turbine exhaust case 28. Frame 100 comprises outer ring 102, inner ring 104, struts 106, installation mounts 108 (with installation mounting holes 110), power turbine connection flange 112 (with power turbine connection holes 114), and multi-function bosses 116 (with outer step surface 118, inner step surface 120, mounting hole 122, service line aperture 124, and seal plate mounting holes 126).

Frame 100 is a rigid support structure that can, for instance, be formed in a unitary steel casting. Frame 100 supports a vane fairing (not shown) that defines at least a portion of a core flow path for airflow F from low pressure turbine 26 to power turbine 30. Frame 100 further acts as a structural support for shaft loads, communicating loads from bearing supports affixed to inner ring 104 through struts 106 to outer ring 102, where turbine exhaust case 28 is anchored to installation structures. Inner ring 104 is a cylindrical support structure that interfaces with bearing supports to receive shaft loads. Struts 106 are circumferentially distributed supports extending radially from inner ring 104 to outer ring 102. One or more of struts 106 include at least one service line channel extending from service line aperture 124, as explained in greater detail below with respect to FIG. 4.

Outer ring 102 serves as the outermost case and mounting surface of turbine exhaust case 28, and includes a plurality of attachment features, including installation mounts 108, power turbine connection flange 110, and multi-function bosses 116. These features can be formed integrally in (i.e., unitarily and monolithically within) outer ring 102. Installation mounts 108 are mounting flanges with power turbine connection holes 114, and are substantially triangularly shaped for downward-facing horizontal load surfaces. Installation mounts 108 are secured via fasteners such as bolts, screws, pins, or rivets through installation mounting holes 110 to mounting brackets (not shown) so as to support turbine exhaust frame 28 in gas turbine engine 10. Power turbine connection flange 112 is an annular flange abutting power turbine 30. Turbine exhaust case 28 is secured to power turbine 30 by bolts, screws, pins, rives, or similar fasteners through power turbine connection holes 114 to power turbine 30. In some instances, installation mounts 108 can carry installation loads from power shaft 36 of power turbine 30 as well as low pressure shaft 32.

Each multi-function boss 116 is a hollow boss extending substantially radially outward from outer ring 102. In the depicted embodiment, each multi-function boss 116 has a stair-stepped profile with two adjacent parallel flat surfaces. Outer step surface 118 is located axially aft and radially outward of inner step surface 120. In this embodiment, inner step surface 120 is recessed relative to outer step surface 118 to provide clearance for a heavy mounting fastener such as a bolt, screw, lug, pin, or rivet secured in mounting hole 122. In other embodiments, multi-function boss 116 can be a single flat plateau surface.

Mounting holes 122 are located in a heavy body of multi-function boss 116 on inner step surface 120 to receive mounting bolts or similar hardware to anchor turbine exhaust case 28. Mounting holes 122 can, for instance, be threaded attachment points for securing turbine exhaust case 28 in an installation position with bolts or screws, supplemental or alternative to installation mounts 108. Mounting holes 122 can additionally or alternatively be used to secure frame 100 for transportation prior to installation.

Figure 3:
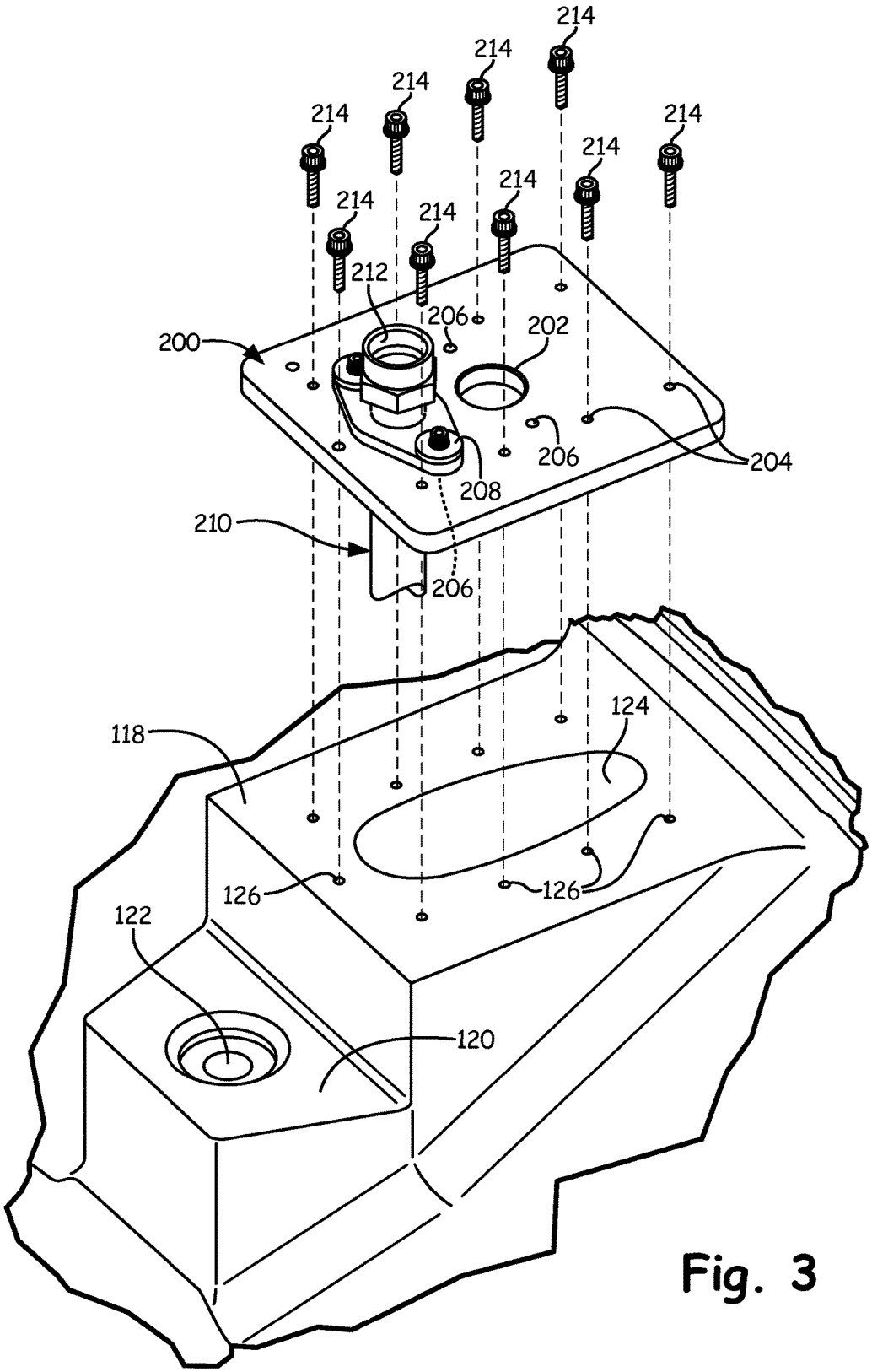
FIG. 3 is a close-up exploded perspective view of a multi-function boss assembly of the turbine exhaust case of FIG. 2
Figure 4:
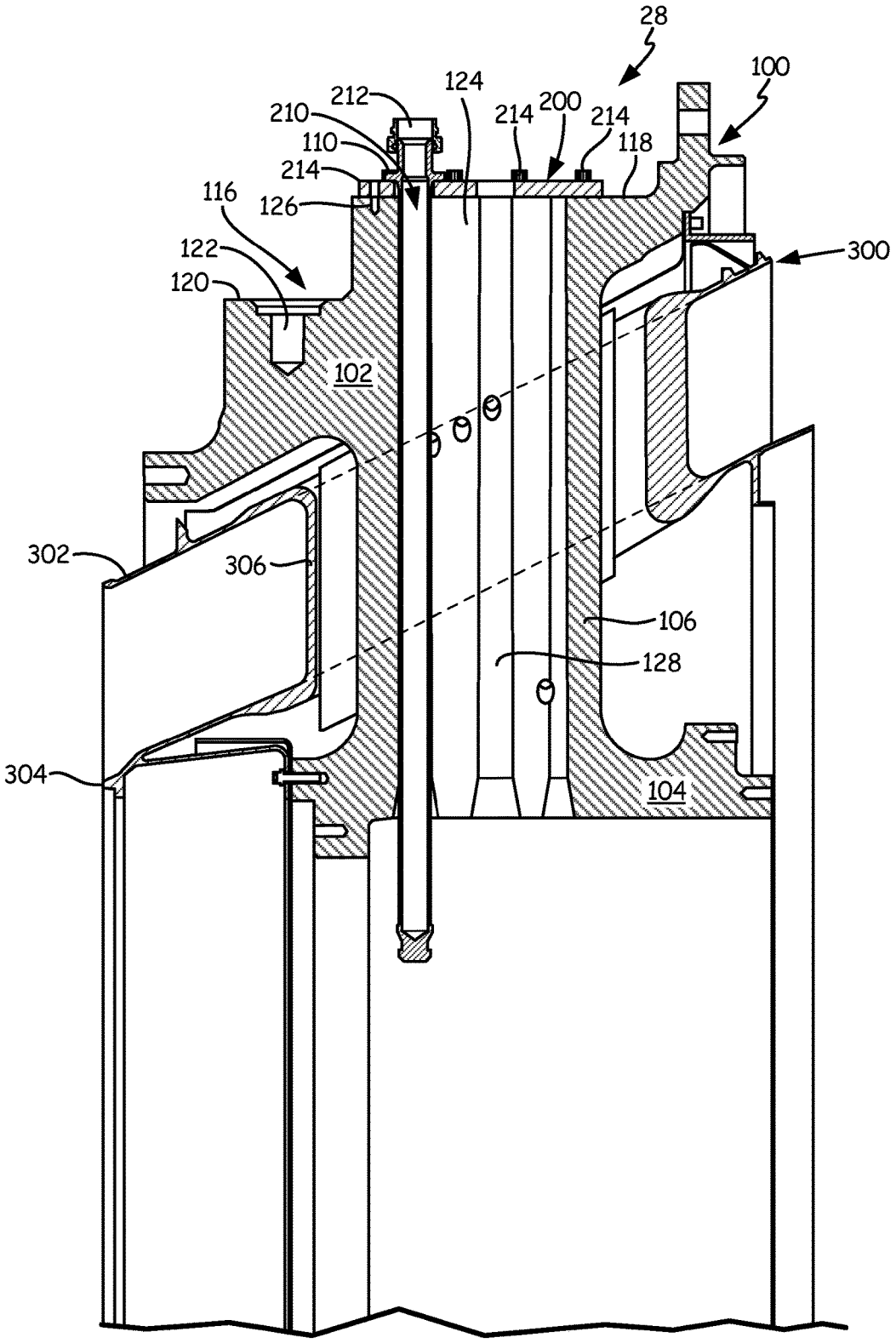
FIG. 4 is a cross-sectional view of the turbine exhaust case of FIG. 2 illustrating the multi-function boss of FIG. 3.

Service line apertures 124 are apertures leading to service line passages through a corresponding strut 106 (see FIG. 4 and accompanying description). Service line apertures 124 provide inlet points for service lines for cooling and lubrication of turbine exhaust case 28. Service line apertures 124 can, for instance, receive oil supply and/or scavenging lines for bearings situated radially inward of inner ring 104, and air supply lines carrying cooling air to maintain operating temperatures of frame 100 and adjacent components of turbine exhaust case 28. A seal plate can be secured to outer step surface 118 (see FIG. 3, described below) to retain cooling air and maintain air pressure within turbine exhaust case 28 via seal plate mounting holes 126.

FIG. 3 is a close-up exploded perspective view of an assembly that includes multi-function boss 116, seal plate 200 (with service line hole 202, seal plate mounting holes 204, and service line mounting holes 206), service line fasteners 208, service line 210 (with service line connection 212), and seal plate fasteners 214.

Each multi-function boss 116 includes outer step surface 118, inner step surface 120, mounting hole 122, service line aperture 124, and seal plate mounting holes 126 as described above with respect to FIG. 2. Seal plate 200 is a flat plate secured to outer step surface 118 by seal plate fasteners 214, which pass through seal plate mounting holes 204 and 126 in seal plate 200 and outer step surface 118, respectively. Seal plate 200 accepts a number of service lines 210, which are attached to seal plate 200 by means of service line fasteners 208, which are secured in seal plate 200 at service line mounting holes 206.

In the depicted embodiment, service line aperture 124 is a single aperture configured to carry multiple service lines. In alternative embodiments, multi-function boss 116 can carry a plurality of service line apertures providing ingress to separate service line passages through strut 106. The depicted embodiment of service line aperture 124 has the advantage of allowing all multi-function bosses 116 to be formed identically, regardless of the number or type of service lines that will eventually pass through each multi-function boss 116, which can vary depending on angular position. Seal plate 200 covers service line aperture 124 to retain cooling air and maintain air pressure within turbine exhaust case 28. In the depicted embodiment, seal plate 200 has two service line holes 202, one of which is occupied by service line 210. Service line 210 comprises one or more tubes, pipes, or other suitable conduits connected in fluid communication carrying, e.g., oil or air for lubrication or cooling, and connects to an oil or air supply via service line connection 212. Depending on the number service lines 210 required at the angular location of each multi-function boss 116, seal plates 200 with different numbers of service line holes 202 can be used. Although one service line hole 202 is depicted as unoccupied in FIG. 3, this is only for illustrative purposes. Angular locations with only one service line, for instance, can be equipped with corresponding seal plates 200 with only one service line hole 202, so that no service line holes 202 are left open once turbine exhaust case 28 is fully assembled. In some embodiments, some seal plates 200 may have no service line holes 202 at all.

FIG. 4 is a cross-sectional view of turbine exhaust case 28 with seal plate 200 secured atop outer step surface 118 of multi-function boss 116. FIG. 3 depicts frame 100 with outer ring 102, inner ring 104, strut 106, multi-function boss 116, and service line passage 128. As described above with respect to FIG. 1, frame 100 has outer step surface 118, inner step surface 120, mounting hole 122, and service line aperture 124, and seal plate mounting holes 126. Seal plate 200 is secured atop service line aperture 124 by seal plate fasteners 214, and carries service line 210 with service line connection 212. FIG. 4 further depicts fairing 300 with outer platform 302, inner platform 304, and fairing vane 306. Fairing vane 306 surrounds strut 106, while inner platform 204 and outer platform bracket inner ring 104 and outer ring 102, respectively. Fairing 300 defines at least a portion of an aerodynamic airflow section path through turbine exhaust case 28, and can for instance be formed of a high-temperature capable superalloy such as Inconel or another nickel-based superalloy. As shown in FIG. 4, service line 212 passes through service line passage 128

As shown in FIG. 4, service line 212 passes through service line passage 128, which extends through strut 106. In the depicted embodiment, service line passage 128 is a contoured passage with a shape selected to retain and space apart up to three service lines at distinct chordwise locations. This contour includes partial circular cross-sectional regions, as shown in FIG. 3, corresponding to each service line. In alternative embodiments, service line passage 128 can include more or fewer such service line retention locations, or can be an uncontoured passage without defined spacers for each service line.

Each multi-function boss 116 provides a plurality of functions in a single, relatively easily- and inexpensively-cast feature. Multi-function bosses 116 provide mounting locations for turbine exhaust case 28 via mounting hole 122 in inner step surface 120, and provide an interface for a plurality of service lines via service line apertures 124. Service line aperture 124 can be generic to any number of service lines, and is sealed by sealing plate 200, which is selected to accept a particular number of service lines for the angular location of each multi-function boss 116.

DISCUSSION OF POSSIBLE EMBODIMENTS

The following are non-exclusive descriptions of possible embodiments of the present invention.

A turbine exhaust case frame comprising an inner ring, an outer ring, and a plurality of load-bearing struts. The inner ring is configured to carry load from inner bearings. The outer ring features a multi-function boss having a service line aperture and a mounting point for the turbine exhaust case. The load-bearing struts connect the inner ring to the outer ring, and have a service line passage extending from the service line aperture to the inner ring.

The turbine exhaust case frame of the preceding paragraph can optionally include, additionally and/or alternatively, any one or more of the following features, configurations and/or additional components:

wherein the service line aperture is an aperture situated to receive a plurality of service lines.

wherein the service line aperture is contoured to retain a plurality of service lines at distinct axial locations.

wherein the service line aperture is configured to accept an air supply line.

wherein the service line aperture is configured to accept an oil supply line wherein the service line aperture is configured to accept an oil scavenging line.

wherein the multi-function boss has a stair-step shape such that the service line interface is situated in an outer step surface of the boss, and the mounting point is situated in an inner step surface of the boss located axially forward and radially inward of the outer step surface.

wherein the outer ring comprises a plurality of bosses, each with the same configuration as the multi-function boss.

wherein the mounting point is a threaded mounting hole configured to receive mounting hardware.

A turbine exhaust case comprising a frame, a seal plate, and a service line. The frame has an inner ring configured to carry load from inner bearings, an outer ring with a multi-function boss having a service line aperture and a mounting point for the turbine exhaust case, and a plurality load-bearing struts connecting the inner ring to the outer ring, and having a service line passage extending from the service line aperture to the inner ring. The seal plate is disposed atop the service line aperture, and includes at least one service line hole. The service line extends through the service line hole, the service line aperture, and the service line passage.

The turbine exhaust case of the preceding paragraph can optionally include, additionally and/or alternatively, any one or more of the following features, configurations and/or additional components:

wherein the frame is formed of cast steel.

wherein the seal plate is secured to the multi-function boss with seal plate fasteners.

and further comprising one or more service lines passing through the seal plate, the service line aperture, and the service line passage, and wherein the seal plate is selected to have a seal plate hole for each service line further comprising a fairing disposed within the frame between the inner ring and the outer ring, the fairing defining an airflow path through the turbine exhaust case.

A method of installing a service line in a turbine exhaust case, the method comprising: attaching a first end of the service line to a seal plate through a service line hole; inserting a second end of the service line opposite the second end through a service line passage extending through a strut of a turbine exhaust case frame; and securing the seal plate to a multi-function boss on an outer ring of the frame, the multi-function seal plate having a service line aperture opening into the service line passage, and a mounting point for the turbine exhaust case.

The method of the preceding paragraph can optionally include, additionally and/or alternatively, any one or more of the following features, configurations and/or additional components:

further comprising selecting the seal plate to have a number of service line holes corresponding to a number of service lines extending through the service line aperture.

wherein the service line passage is contoured to receive and position a plurality of service lines at distinct chordwise locations.

wherein the service line passage is contoured to receive and position three service lines at distinct chordwise locations.

While the invention has been described with reference to an exemplary embodiment(s), it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An exhaust case frame for a turbine, the exhaust case frame comprising:

an inner ring configured to carry load from inner bearings;

an outer frustoconical ring angled away from a rotational axis of the turbine in an axially aftward direction, the outer ring having a multi-function boss, the multifunction boss comprising:

a service line aperture in a first, radially-outboard plane; and a heavy body with a mounting point in a second plane axially forward and radially inward of the first plane;

wherein the first plane is parallel to the second plane; and wherein the first plane and second plane are parallel to the rotational axis such that the outer ring is angled with respect to the first plane and the second plane;

a plurality of load-bearing struts connecting the inner ring to the outer ring, and having a service line passage extending from the service line aperture to the inner ring; and a seal plate disposed atop the service line aperture such that the seal plate defines a third plane radially outward from the first plane, the seal plate comprising at least one service line hole extending therethrough, the at least one service line hole having a smaller area than the service line aperture.

2. The turbine exhaust case frame of claim 1, wherein the service line aperture is an aperture configured to receive a plurality of service lines.

3. The turbine exhaust case frame of claim 2, wherein the service line aperture is contoured to retain a plurality of service lines at distinct axial locations.

4. The turbine exhaust case frame of claim 1, wherein the service line aperture is configured to accept an air supply line.

5. The turbine exhaust case frame of claim 1, wherein the service line aperture is configured to accept an oil supply line.

6. The turbine exhaust case frame of claim 1, wherein the service line aperture is configured to accept an oil scavenging line.

7. The turbine exhaust case frame of claim 1, wherein the outer ring comprises a plurality of bosses, each with the same configuration as the multi-function boss.

8. The turbine exhaust case frame of claim 1, wherein the mounting point is a threaded mounting hole configured to receive mounting hardware.

9. The turbine exhaust case frame of claim 1, wherein the frame is formed of steel.

10. The turbine exhaust case frame of claim 1, wherein the seal plate is secured to the multi-function boss with seal plate fasteners.

11. The turbine exhaust case frame of claim 1, and further comprising one or more service lines passing through the seal plate, the service line aperture, and the service line passage, and wherein the seal plate is selected to have a seal plate hole for each service line.

12. The turbine exhaust case frame of claim 1, further comprising a fairing disposed within the frame between the inner ring and the outer ring, the fairing defining an airflow path through the turbine exhaust case.

13. A method of installing a service line in an exhaust case for a turbine, the method comprising:

attaching a first end of the service line to a seal plate through a service line hole;

inserting a second end of the service line opposite the second end through a service line passage extending through a strut of a turbine exhaust case frame; and securing the seal plate to a multi-function boss on an outer ring of the frame, the outer ring being a frustoconical structure angled away from a rotational axis of the turbine in an axially aftward direction, wherein the multi-function boss comprises:

a service line aperture in a first, radially-outboard plane, the service line aperture opening into the service line passage; and a heavy body with a mounting point for the turbine exhaust case in a second plane axially forward and radially inward of the first plane;

wherein the first plane is parallel to the second plane;

wherein the first plane and second plane are parallel to the rotational axis such that the outer ring is angled with respect to the first plane and the second plane; and wherein the seal plate is disposed atop the service line aperture such that the seal plate defines a third plane radially outward from the first plane; and wherein the service line hole has a smaller area than the service line aperture.

14. The method of claim 13, further comprising selecting the seal plate to have a number of service line holes corresponding to a number of service lines extending through the service line aperture.

15. The method of claim 13, wherein the service line passage is contoured to receive and position a plurality of service lines at distinct chordwise locations.

16. The method of claim 13, wherein the service line passage is contoured to receive and position three service lines at distinct chordwise locations.

* * * * *